US009580292B2

(12) United States Patent
Smith et al.

(10) Patent No.: US 9,580,292 B2
(45) Date of Patent: Feb. 28, 2017

(54) VENTED TAP DISPENSER FOR LIQUID

(71) Applicant: The Procter & Gamble Company, Cincinnati, OH (US)

(72) Inventors: Christopher Lawrence Smith, Liberty Township, OH (US); William Kater Lasala, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 107 days.

(21) Appl. No.: 14/205,848

(22) Filed: Mar. 12, 2014

(65) Prior Publication Data

US 2015/0259188 A1 Sep. 17, 2015

(51) Int. Cl.
*B67D 3/00* (2006.01)
*B67D 3/04* (2006.01)

(52) U.S. Cl.
CPC ..... *B67D 3/0061* (2013.01); *B67D 3/0035* (2013.01); *B67D 3/046* (2013.01)

(58) Field of Classification Search
CPC ..... B67D 3/0061; B67D 3/0035; B67D 3/043; B65D 47/06; B65D 47/32
USPC ..... 222/478
See application file for complete search history.

(56) References Cited

U.S. PATENT DOCUMENTS

| | | | | |
|---|---|---|---|---|
| 2,113,046 | A | 4/1938 | Freemon | |
| 2,661,018 | A | 12/1953 | Snyder | |
| 4,386,718 | A * | 6/1983 | Stewart et al. | 222/185.1 |
| 5,133,482 | A * | 7/1992 | Burrows et al. | 222/185.1 |
| 5,211,314 | A | 5/1993 | Burrows | |
| 5,405,058 | A * | 4/1995 | Kalis et al. | 222/185.1 |
| 5,509,583 | A * | 4/1996 | Dolson | 222/185.1 |
| 5,524,864 | A * | 6/1996 | Dubach | 251/267 |
| 5,678,737 | A | 10/1997 | White | |
| 5,988,458 | A * | 11/1999 | Messner | 222/478 |
| 6,892,903 | B1 * | 5/2005 | Bartolotta | 222/185.1 |
| 2005/0274735 | A1 * | 12/2005 | Patel et al. | 222/83.5 |
| 2007/0251955 | A1 * | 11/2007 | Green | 222/185.1 |
| 2008/0314930 | A1 * | 12/2008 | Green | 222/185.1 |
| 2013/0341366 | A1 * | 12/2013 | Campbell et al. | 222/505 |

FOREIGN PATENT DOCUMENTS

WO WO 99/32393 A1 7/1999

OTHER PUBLICATIONS

International Search Report for International Application U.S. Appl. No. PCT/US2015/020132, mailed May 25, 2015, 13 pages.

* cited by examiner

*Primary Examiner* — Patrick M Buechner
*Assistant Examiner* — Jeremy W Carroll
(74) *Attorney, Agent, or Firm* — Lauren Christine Gonzalez; Gary J. Foose

(57) ABSTRACT

A tap dispenser having a main body, said main body having a main body interior portion and an opposing main body exterior portion; a liquid flow pathway passing through the main body; a vent pathway passing through the main body, wherein air transport through the vent pathway is separated from liquid transport through said liquid flow pathway and wherein the vent pathway has a vent pathway inlet and an opposing vent pathway outlet; a vent valve operably engaged with the vent pathway outlet; and a liquid flow valve operably engaged with the liquid flow pathway.

17 Claims, 6 Drawing Sheets

VENTED TAP DISPENSER FOR LIQUID

FIELD OF THE INVENTION

Vented press tap dispenser.

BACKGROUND OF THE INVENTION

The number of consumers who purchase liquid goods, such as detergent, wine, and other consumables, in bulk has continued to increase over the past decade. A typical detergent container might contain approximately 2 L of liquid detergent. A typical wine bottle might contain approximately 750 mL. To reduce the cost to consumers related to packaging, marketers of liquids such as detergents and wine are increasing their offerings of larger sizes of containers for such fluids. As the containers become larger, they tend to become more and more difficult to pour because the person dispensing the liquid must have adequate wrist strength to controllably pour the liquid. To overcome these difficulties, marketers now offer to consumers containers having a tap dispenser that allow the consumers to dispense fluid without having to lift the container. It is now not uncommon to see detergents, wine, cooking oils, and other bulk liquids packaged in containers having a tap dispenser.

When the container and tap dispenser are placed in operable position the tap dispenser is below the container so that the contents of the container can flow out of the tap dispenser. As fluid flows out of the container the container decreases in volume or the container is vented to allow air to replace the volume of fluid discharged from the container.

Collapsible containers can be used in embodiments in which the container is housed in a rigid carton in what is referred to in the art as a bag in a box type execution. Wine is commonly sold in a bag in a box type execution.

Liquid laundry detergent is presently marketed in a rigid container having a tap dispenser, in particular a press tap dispenser. Since the container is rigid, as laundry detergent is dispensed air is vented into the container to replace the volume of laundry detergent dispensed. Air can be vented into a rigid container through a tap dispenser by flow of air in a direction opposite to the direction of in which liquid is dispensed. When the container is vented in this manner, the flow rate of liquid out of the tap is irregular as bubbles of air enter the liquid stream and move up stream into the container. Irregular dispensing is unattractive to the consumer because dispensing the precise amount of liquid becomes difficult.

To overcome the problem that arises when the pathway for liquid discharge and the venting are the same, the container can be provided with a venting chimney. The venting chimney can be provided in the container at a position that is above the surface of the liquid when the container and tap dispenser are in operable position. The venting chimney can be an additional opening having a threaded closure that opened by the consumer after she places the container and tap dispenser in operable position. Such an approach is used in packaging for TIDE liquid detergent in which the detergent is dispensed via a press tap. Alternatively, the venting chimney can be a one-way check valve in the container that allows air into the container but does not allow liquid to exit the container.

Venting chimneys are undesirable for multiple reasons. Firstly, a venting chimney is an extra part of the container which increases the cost of the packaging. Secondly, venting chimneys occasionally leak during shipping and storage of the container. Thirdly, in some embodiments, the consumer has to open the venting chimney to allow the chimney to function. If the consumer forgets to open the venting chimney or does not know how to open the venting chimney, the consumer may be dissatisfied with the experience of dispensing the product. Consumer dissatisfaction may arise due to unsteady dispensing of the liquid, collapse of the container, cracking of the container, or leakage.

With these limitations of venting chimneys in mind, there is a continuing unaddressed need for technical approaches for venting containers from which the liquid contents are dispensed via tap dispenser.

SUMMARY OF THE INVENTION

A tap dispenser comprising: a main body, said main body having a main body interior portion and an opposing main body exterior portion; a liquid flow pathway passing through said main body; a vent pathway passing through said main body, wherein air transport through said vent pathway is separated from liquid transport through said liquid flow pathway and wherein said vent pathway has a vent pathway inlet and an opposing vent pathway outlet; a vent valve operably engaged with said vent pathway outlet; and a liquid flow valve operably engaged with said liquid flow pathway.

DETAILED DESCRIPTION OF THE INVENTION

Figure 1:
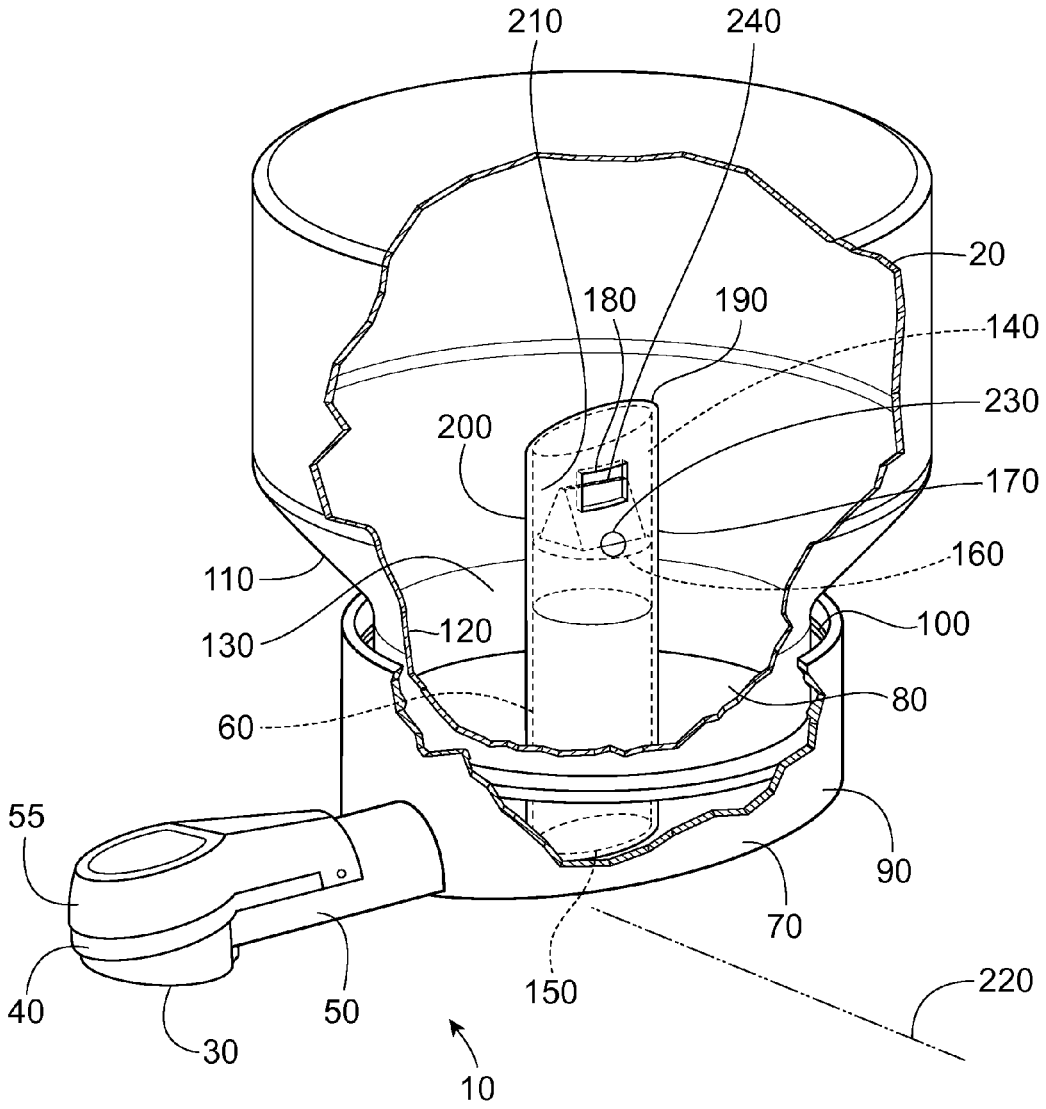
FIG. 1 is a perspective view of a tap dispenser and container.

A tap dispenser 10 is shown in FIG. 1. The tap dispenser 10 can be attached to a container 20 containing liquid. In FIG. 1, a partial view of the container 20 is rendered. The container 20 can have the shape of a typical polyethylene terephthalate 2 L bottle of soda sold in North America. The container 20 can have other shapes such that the container 20 is statically stable when positioned in operable position and connected to the tap dispenser 10 and any other appurtenances associated with the tap dispenser 10.

When the tap dispenser 10 is in operable position, the tap dispenser 10 is below the container 20 so that liquid in the container 20 can flow down-gradient from the container 20 to the tap dispenser 10. Stated otherwise, the total head of liquid contained in the container 20 is greater than the total head at the liquid flow outlet 30. In use, liquid from within the container 20 can be dispensed through the tap dispenser 10. The container 20 may be housed in a pedestal supporting one or both of the container 20 and the tap dispenser 10.

The tap dispenser 10 may be provided with a liquid flow valve 40 that can be actuated by the user to start and stop flow of liquid. The liquid flow valve 40 is operably engaged with the liquid flow pathway 50. The liquid flow valve 40 can be any type of valve that is capable of being controlled by a user to start and stop flow of the liquid. The liquid flow valve 40 can be a ball valve or a press tap valve. In the embodiment shown in FIG. 1, liquid flow through the liquid flow valve 40 can be initiated by the user pressing on lever 55 to open the liquid flow valve 40 and releasing the lever 55 to close the liquid flow valve 40. The liquid flow valve 40 can be comprised of press bulb operably engaged with a stem having a plug attached to the stem, the plug being movable from a closed position to an open position. Such a press bulb is used for dispensing from large containers of laundry detergent such as liquid TIDE.

If the container 20 is rigid under the pressures exerted on the container as liquid is dispensed, as liquid is dispensed from the container 20, the volume of liquid dispensed needs to be replace with air. Air can enter the container 20 by flowing upstream against the direction of liquid flow in the liquid flow pathway 50. Air moving in the liquid flow pathway 50 in a direction opposite the direction of liquid flow therein can tend to result in pulsed flow as flow ceases or nearly ceases when the bubble enters the liquid flow outlet 30. When the fluid is relatively thick, for instance as is the case for liquid laundry detergent, oil, and maple syrup, and like liquids, the surface tension and momentum of the liquid impede upstream movement of the air bubble, limiting replacement of liquid volume in the container 20 with air, thereby resulting in low and unsteady liquid flow rates.

To avoid the problems associated with air flow and liquid flow being provided in the same pathway, the container 20 can be provided with a vent. The vent can be a structurally weakened portion of the container that is punctured above the liquid level in the container 20 when the container is in operable position. The vent can be a vent chimney similarly located that it can be opened, for instance by loosening a threaded closure. Structurally weakening the container 20 to provide a vent is not an attractive option for venting since thick fluids tend to have high density leading to heavy filled containers that must be structurally strong during manufacture, transport, and storage. Vent chimneys can also be undesirable since they are more complicated to manufacture and require an additional opening of the container, which increases the complexity of use of the container 20 and increases the risk of a leak in the container.

As shown in FIG. 1, the tap dispenser 10 can have a main body portion 70. The main body 70 can be can be the portion of the tap dispenser 10 that attaches to the container 20. The main body 70 can be attached to the container 20, by way of non-limiting example, by a threaded connection. The main body 70 can have a main body interior portion 80 and an opposing main body exterior portion 90. The main body 70 can be provided with interior threads 100 on the interior portion 80 of the main body 70 to engage with threads 100 disposed on or in the exterior surface 110 of the neck 120 of the container 20. The main body 70 can be provided with threads 100 on the exterior portion 90 to engage with threads 100 disposed on the interior surface 130 of the neck 120 of the container 20. The main body 70 can comprise o-ring that that is part of an active system on the main body 70 to engage with the interior of the neck 120 of the container.

The main body 70 can be fabricated from plastic or metal. By way of non-limiting example, the main body 70 can comprise nylon, polyethylene, polypropylene, or other plastic material from which molded parts can be constructed. The main body 70 can be engaged with the container 20 to seal the container 20 closed.

The tap dispenser 10 can be provided with a liquid flow pathway 50 passing through the main body 70. That is, the liquid flow pathway 50 can fluidly connect the interior of the container 20 to the exterior of the container 20. When the user activates the liquid flow valve 40, liquid from within the container 20 is passes through the main body 70 and through the liquid flow pathway 50 past the liquid flow valve 40 and out the liquid flow outlet 30. At the liquid flow pathway 50, the user can collect the liquid in a dosing cup or other such container or apply the liquid directly to another substance, surface, or volume.

The liquid flow pathway 50 can be comprised of a plastic, metal, or other fluid impermeable material. The liquid flow pathway 50 can be a conduit having an open cross sectional area through which liquid flow can occur. The liquid flow pathway 50 can be integral with or joined with one or more of the liquid flow valve 40 and main body 70.

The tap dispenser 10 can further comprise a vent pathway 60. The vent pathway 60 can pass through the main body 70. The vent pathway 60 has vent pathway inlet 150 and an opposing vent pathway outlet 160. The direction of air-flow through the vent pathway 60 is desirably in the direction from the vent pathway inlet 150 exposed to the external environment towards the vent pathway outlet 160 which is in fluid communication with the interior of the container 20. The vent pathway 60 can fluidly connect the interior of the container 20 to the exterior of the container 20. In the case of the vent pathway 60, the fluid to be transported there through is air. When the user activates the liquid flow valve 40 to commence liquid flow, air can enter the interior of the container 20 through the vent pathway 60 to replace the volume of liquid discharged from the container 20.

To prevent liquid from flowing out of the container 20 through the vent pathway 60, the vent pathway can be provided with a vent valve 140. The vent valve 140 can be a valve that is capable of providing for one directional movement of air through the vent valve 140. The vent valve 140 can be a duck bill valve.

The vent valve 140 can be a valve that opens in response to decrease in pressure within the container 20 that occurs as liquid is dispensed from the container 20. When the vent valve 140 opens, air from outside the container 20 enters into the container 20 to equalize the pressure within the container 20 with the pressure outside the container 20. The vent valve 140 can be resistive to flow of liquid in the direction opposite to the direction of airflow through the vent valve 140. The vent valve 140 can have a vent valve opening 240 through which airflow can occur.

Air transport through the vent pathway 60 can be separated from liquid transport through the liquid flow pathway 50. This can help to provide for steady flow of liquid from the container 20 when liquid is being dispensed since air bubbles do not have to move against the flow of the liquid to equalize the pressure within the container 20 with the pressure outside of the container 20.

As shown in FIG. 1 and elsewhere, the vent pathway outlet 160 can be higher than the liquid flow inlet 280 when the tap dispenser 10 is in operable position. Such an arrangement can be desirable to provide for separation of liquid flow and air flow so that air flow out of the vent pathway 160 from venting does not interfere with liquid flow towards the liquid flow inlet 280.

The vent pathway outlet 160 can have a valve cover 170 extending from the vent pathway outlet 160 and at least partially enclosing the vent valve 140. The valve cover 170 can have a valve cover opening 180. The valve cover 170 can protect the vent valve 140 from being damaged when the tap dispenser 10 is disengaged from a container 20. The vent valve cover 170 can also protect the vent valve 140 from fouling that can occur to an uncovered vent valve 140 when the container 20 is nearly empty and drips from the surface of the container 20 above the vent valve 140 drip onto the vent valve 140. If the vent valve 140 is a duck bill valve, drips impacting the duck bill valve from above over time can reduce the integrity of the seal provided by the facing panels of the duck bill valve and or make the duck bill valve require more pressure differential to open the duck bill valve. The valve cover opening 180 can provide for transport of air from the vent valve 140 to the interior of the container 20. Drips can arise as a result of the surface tension of the liquid contained in the container 20 enabling some of the liquid to be retained on the surface of the interior of the container 20 above the vent valve 140. Further, drips can arise at and from such location as a result of condensation within the container 20.

As shown in FIG. 1, the valve cover 170 can be a generally cylindrical partial enclosure around the vent valve 140. The valve cover 170 can be joined to the vent pathway 60. The valve cover 170 can comprise a terminal cover 190 having a terminal cover periphery 200 and a peripheral wall 210 extending from the terminal cover periphery 200 to the vent pathway outlet 160. When the tap dispenser 10 is in operable position, the terminal cover 190 can be at an incline relative to a datum 220 orthogonal to a gravitational liquid driving force. The datum 220 can be the surface supporting the container 20 and tap dispenser 10. The datum 220 can be considered to be the floor of the room in which the consumer is using the tap dispenser 10. The driving force for dispensing liquid from the container 20 can be gravity which operates generally orthogonal to the floor of a user's household.

An inclined terminal cover 190 promotes liquid drainage off of the terminal cover 190. For, drips that fall from the interior surface of the container 20 above the vent valve 140, the drips can hit the terminal cover 190 and the incline thereof promotes runoff of the fluid from the terminal cover 190. This can help to aid in dispensing all of the liquid from within the container 20, which is a consumer desirable trait, particularly for liquids that are perceived as costly.

An inclined terminal cover 190 can also help with providing the consumer with a cleaner experience when she changes the tap dispenser 10 from one container 20 to another container. In this process, she might remove the tap dispenser 10 from a first container 20. Then she may casually set down the tap dispenser 10 on a table or top of the washing machine or dryer such that the tap dispenser 10 is resting on its side or is tilted. If the liquid is high density liquid laundry detergent, a single drip accumulated on the terminal cover 190 might drip or run off of the terminal cover 190 onto the surface on which the tap dispenser 10 is resting. Given the tendency of surfactants commonly found in liquid laundry detergents to readily spread on surfaces, the user may find that the top of her washing and dryer has a fairly large area of sticky and gummy liquid laundry detergent that later accumulates unsightly and unsanitary dirt and dust.

The valve cover 170 can be provided with a valve cover opening 180. The invert elevation of the valve cover opening 180 can be above, at, or below the invert elevation of the vent valve 140. By invert elevation, it is meant the lowest elevation of the opening through which fluid transport can occur when the tap dispenser 10 is in use. For instance, for an open pipe resting lengthwise on a flat surface, the invert elevation is the bottom of the open area of the pipe. Alternatively, the invert elevation of the pipe can be expressed as the wall thickness of the pipe above the surface on which the pipe is resting. For a duck bill valve set so that the opening slit is parallel to the surface on which the duck bill valve rests, the invert elevation is the elevation of the slit.

If the invert elevation of the cover opening 180 is at or above the vent valve 140, then the vent valve 140 will be wet when in operable position. If the invert elevation of the cover opening 180 is below the vent valve 140, then the vent valve 140 can be maintained to be dry when in operable position. Use of dry or wet valves can be selected based on the compatibility of the material from which the valve is constructed and the liquid that is being dispensed with the tap dispenser. If the liquid is liquid laundry detergent, a wet valve condition may be desirable. If the invert elevation of the cover opening 180 is below the vent valve 140, the valve cover opening 180 can function as both a vent to permit the movement of air and as a drain to allow any liquid within the valve cover 170 to drain out as the liquid level is lowered to be below the valve cover opening 180 as liquid is dispensed from the container 20.

The valve cover 170 can optionally be provided with a valve cover drain 230. The valve cover drain 230 can be located such that when the tap dispenser 10 is in use, as the liquid level in the container 20 recedes below the vent valve 40, liquid within the valve cover 170 drains out of the valve cover 170. This can enable the user to completely dispense all the liquid from the container, with the exception of liquid retained by surface tension between the liquid and the interior of the container 20 and components of the tap dispenser 10. Further, when the user disengages the tap dispenser 10 from the container 20, there is little of now residual liquid contained in the valve cover 170. This can be advantageous when the user sets the tap dispenser 10 down because there will be little or no residual liquid within the valve cover 170 that can drain or drip out of the valve cover 170 cover and result in mess onto the surface where the tap dispenser 10 is resting or on the floor in the room where the tap dispenser 10 is being changed.

Figure 2:
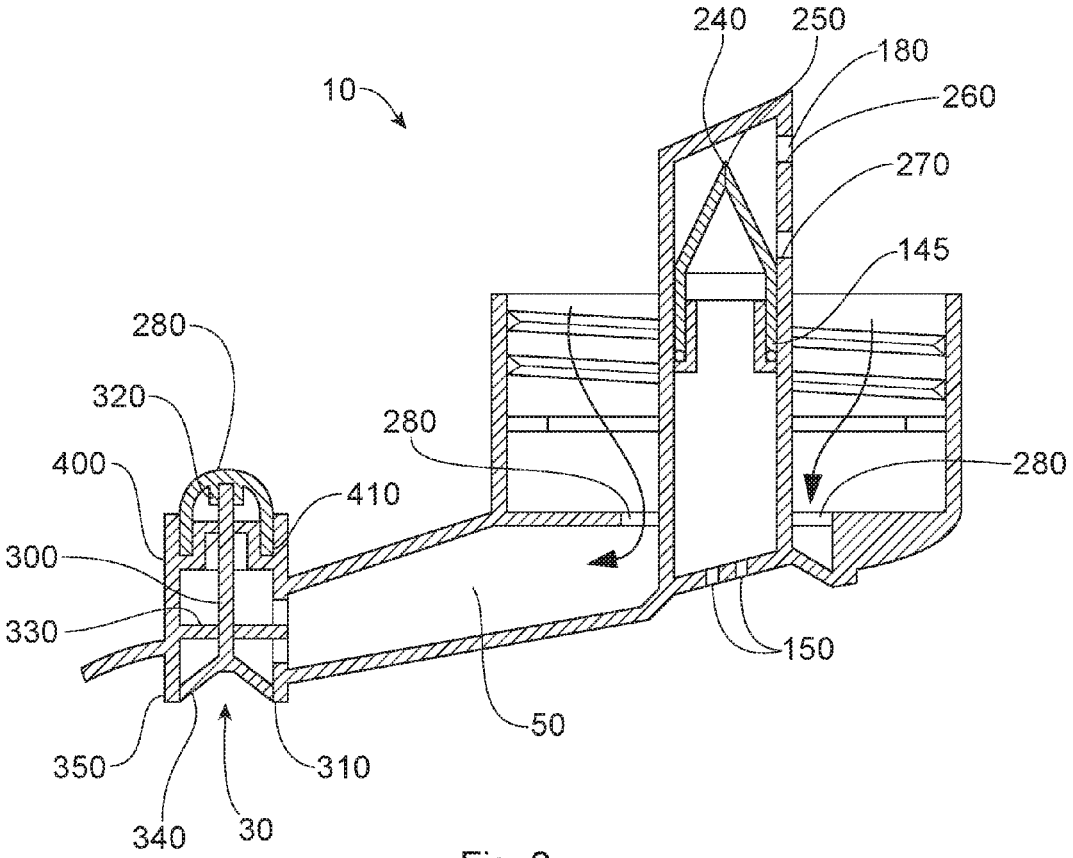
FIG. 2 is a cross sectional view of a tap dispenser and container.

A cross sectional view of a tap dispenser 10 is shown in FIG. 2. As shown in FIG. 2, the vent valve 140 can have a valve opening 240 at a valve opening invert elevation 250. The valve cover opening 180 can have a valve cover opening invert elevation 260. The valve cover opening invert elevation 260 can be the same as or higher than the valve opening invert elevation 250 when the tap dispenser 10 is in operable position.

The valve cover 170 can have a valve cover opening 180 and a valve cover drain 230. The vent valve 140 can have a valve opening 240 at a valve opening invert elevation 250 and the valve cover opening 180 can have a valve cover opening invert elevation 260. The valve cover opening invert elevation 260 can be the same as or higher than the valve opening invert elevation 250 when the tap dispenser 10 is in operable position. The valve cover drain 230 can have a valve cover drain invert elevation 270. The valve opening invert elevation 250 can be above the valve cover drain invert elevation 270 when the tap dispenser 10 is in operable position.

In a typical use of the tap dispenser 10, the tap dispenser 10 will be used as follows. First the user obtains a container 20 of the liquid to be dispensed. The container 20 will be placed so as to be resting on the base of the container 20. The closure, possibly a threaded closure, will be removed from the container 20, thereby revealing the open end of the container 20. The tap dispenser 10 will be engaged with the open end of the container 20. The container 20 and tap dispenser 10 engaged thereto will be inverted into operable position. The valve cover 170 will fill or partially fill with the liquid. Air dislodged from the valve cover 170 will bubble upwards within the container. Liquid from the container 20 will be dispensed using the tap dispenser 10. The liquid level within the container 20 will drop. During dispensing of the liquid, as liquid flows out of the container 20, the pressure within the container 20 will drop. Once the pressure within the container 20 is low enough to open the vent valve 140, air will enter the container through the vent valve 140.

Eventually, enough liquid will have been dispensed such that the liquid level within the container 20 will drop to be coincident with and then below the valve opening invert elevation 250. As the liquid level in the container 20 continues to drop, liquid within the valve cover 170 can flow out of the valve cover drain 230.

The valve cover 170 can be integral with the vent pathway 60. The valve cover 170 can be joined to the vent pathway 60. The valve cover 170 can fit over or within the vent pathway 60. The vent valve 140 can be seated against an o-ring 145 that is seated against a portion of the vent pathway 60. This arrangement can help reduce the potential for leakage of liquid out of the container 20 through the vent pathway 60.

As shown in FIG. 2, the liquid flow pathway 50 can have a liquid flow inlet 280 proximal the main body 70 and a liquid flow outlet 30 distal to the main body 70. The liquid flow inlet 280 can be higher than the liquid flow outlet 30 when the tap dispenser 10 is in operable position. By providing a sloped liquid flow pathway 50, liquid within the container 20 can be delivered at a higher flow rate as compared to a liquid flow pathway that is flat since the total head drop is greater when a sloped liquid flow pathway 50 is used. Further, such a sloped liquid flow pathway 50 can enable the user to get all of the liquid out of the system, thereby providing maximum economy to the user and reducing the potential for a mess when the tap dispenser 10 is changed from one empty or relatively empty container 20 to another full container 20.

The liquid flow pathway 50 and a portion of the vent pathway 60 can be in an annular relationship with one another, as shown in FIG. 2. Arranging the liquid flow pathway 50 and vent pathway 60 as such can provide for a compact tap dispenser 10.

The liquid flow valve 40 can be operably engaged with the liquid flow pathway 50. The liquid flow valve 40 can comprise a resilient member 280. The resilient member 280 can be operably engaged with a sealing member 340 by a stem 300 contained within the liquid flow valve 40. The interior portion of the resilient member 280 oriented towards the sealing bead 310 can have a hollow cylindrical housing 320 in which the stem 300 is mounted. The stem 100 can be held in the housing 320 by compression provided by that part of the resilient member 280. The stem 100 operably engages the resilient member 280 with the sealing member 340.

The stem 300 can pass through a valve guide 330. The valve guide 330 can be an annulus, for example a plastic annulus, through which the stem 300 passes, the annulus being fixedly connected to the liquid flow valve 40. The valve guide 330 can aid in keeping the stem 300 properly aligned within the liquid flow valve 40 so as to provide linear movement of the stem 300 within the liquid flow valve 40.

When the resilient member 280 is not depressed, the resilient member 280 can be seated in the valve housing 350 and can pull the sealing member 340 towards the liquid flow valve housing 350 to close the liquid flow valve 40. When pressure is applied to the resilient member 280, for instance by pressing with a digit or pressing by applying force to a lever 55, the resilient member 280 can be deformed, thereby moving the stem 300 to unseat the sealing bead 310 from the valve housing 350, thereby permitting flow of liquid.

Any one of or all of the components of the liquid flow valve 40 can be formed of metal or plastic material.

The resilient member 280 can be a hollow flexible press bulb operably engaged with the stem 300, as shown in FIG. 2. The resilient member can be the same as that sold with large containers of liquid TIDE having a press tap, marketed by The Procter & Gamble Co., Cincinnati, Ohio, U.S.A. The resilient member 280 can be capable of repetitive large deformation under direct or indirect manually applied pressure but subsequently capable of resuming its original shape when the pressure is removed. The resilient member 280 can be formed from an elastomeric polymer such as ethylene vinyl acetate, metallocene polyethylene, or polybutylene terephthalate. The resilient member 280 can be a hollow flexible hemispherical press bulb having a diameter between about 10 mm and about 25 mm. The resilient member 280 can be a hollow flexible hemispherical press bulb having a diameter of about 18 mm.

The resilient member 280 can be partially embedded in the liquid flow valve body 400 in a channel 410 formed therein, as shown in FIG. 2. The resilient member 280 can be mounted to the liquid flow valve body 400 using an adhesive or can be bonded to the liquid flow valve body 400.

To promote high discharge rates of the liquid from the container 20, the liquid flow pathway 50 can be straight. Similarly, the vent pathway 60 can be substantially straight. A substantially straight vent pathway 60 can make it easier for the user to rinse out the vent pathway 60 and or vent valve 140, if the vent pathway and or vent valve 140 becomes soiled with liquid, dirt, dust, or grime. The vent pathway 60 can have an open cross section area greater than about 6 $mm^2$ Such a large open cross sectional are can make it easier for the user to rinse out the vent pathway 60. During rinsing, smaller open cross sectional areas can tend to become vapor locked, thereby preventing complete rinsing of the vent pathway 60 and vent valve 140.

Figure 3:
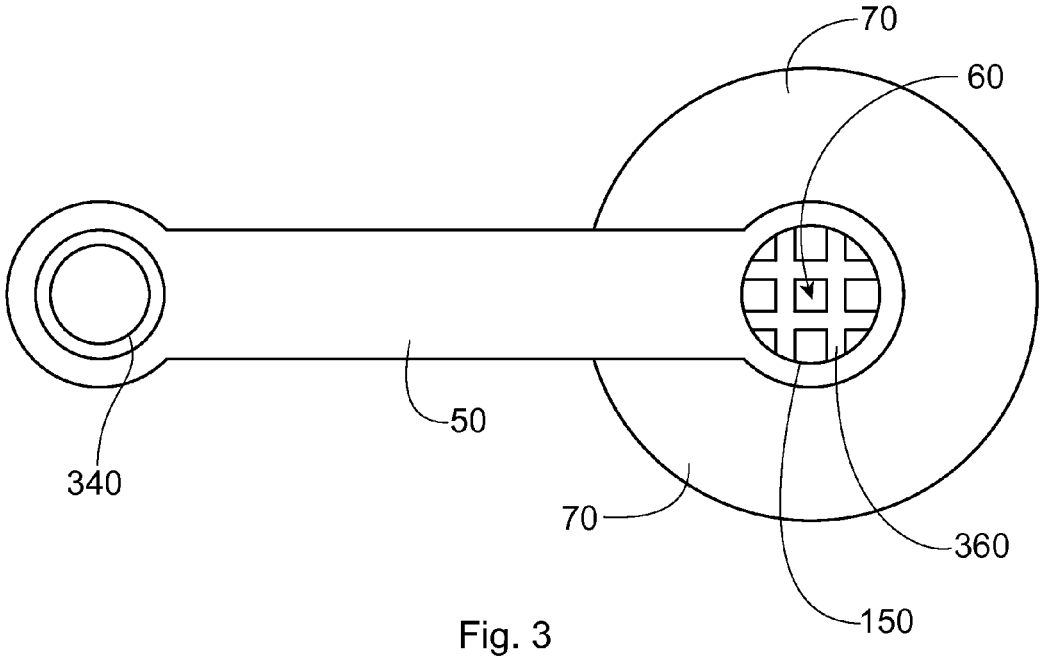
FIG. 3 is a bottom view of a tap dispenser.

A bottom view of a tap dispenser 10 is shown in FIG. 3. The vent pathway inlet 150 can be provided with a fluid pervious cover 360. The fluid pervious cover 360 can be a screen joined to or proximal to the vent pathway inlet 150. The fluid pervious cover 360 can be an integrally molded part of the vent pathway 60. The fluid pervious cover 360 can permit air and liquid to pass there through. The fluid pervious cover 360 can permit water used to rinse the vent pathway 60 and or vent valve 140 to pass through the fluid the pervious cover 360.

Figure 4:
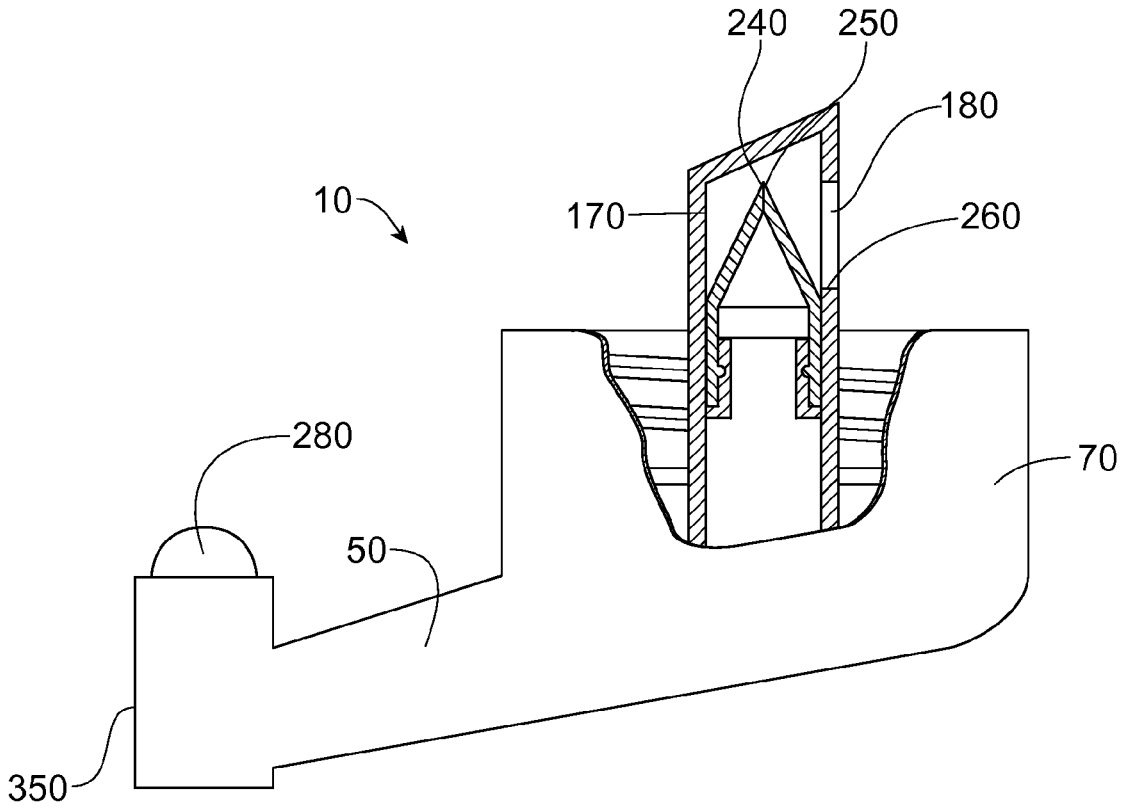
FIG. 4 is a side view of a tap dispenser, a portion of which is rendered in sectional view.

The valve cover 170 can be provided with a valve cover opening 180 that that extends from below the valve opening 240 to at or above the valve opening 240. As shown in FIG. 4, the vent valve 140 has a valve opening 240 at a valve opening invert elevation 250 and the valve cover opening 180 has a valve cover opening invert elevation 260. When the tap dispenser 10 is in operable position the valve cover opening invert elevation 260 can be below the valve opening invert elevation 250 and the valve cover opening 180 extends above the valve opening invert elevation 250. In such an arrangement, air entering the container 20 through the vent valve 140 can bubble up into the container 20 unimpeded. As liquid is discharged from the container 20 and the liquid level lowers to below the valve opening 240, the liquid in valve cover 170 can drain out of the valve cover 170. Thus, the user is able to more completely discharge liquid from the container 20. Further, when the user removes the tap dispenser 10 from the container 20 when the container 20 is empty, the potential for a messy discharge from the valve cover 170 is reduced.

The vent valve 140 can be a passive vent valve 140. A passive vent valve 140 is a valve that opens in response to a difference in pressure across the vent valve 140 and automatically closes once the difference in pressure across the vent valve 140 decreases to a certain level. The vent valve 140 can be a valve selected from the group consisting of an umbrella valve, a duck bill valve, a slit valve, a ball valve, a flapper valve, poppet and needle valve, and a reed valve.

Figure 5:
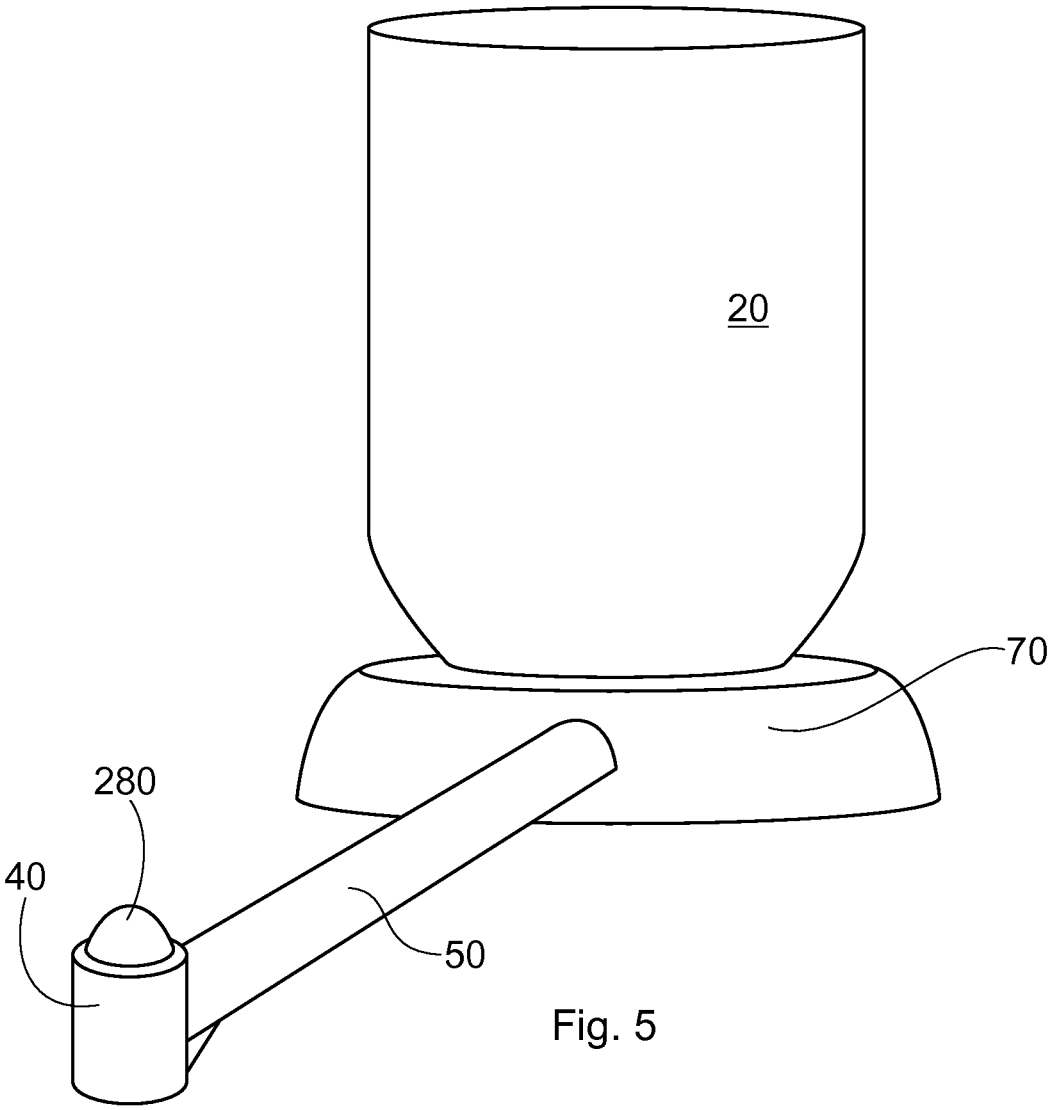
FIG. 5 is a view of a tap dispenser and container.
Figure 6:
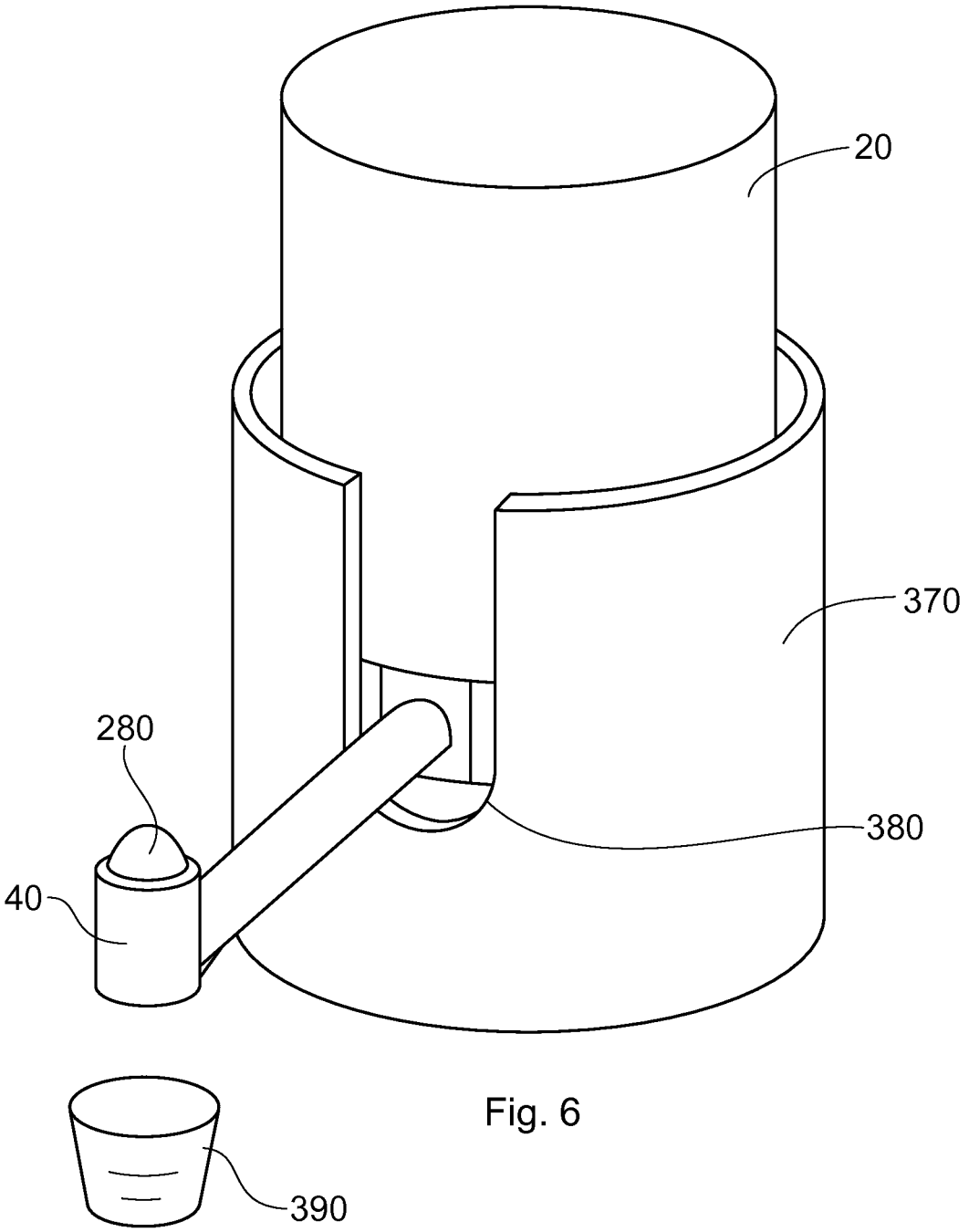
FIG. 6 is a view of a tap dispenser and container resting in a pedestal.

In use, the tap dispenser 10 can rest on a flat surface and support the container 20. The main body 70 can be sized and dimensioned to support the container 20 when in use, as shown in FIG. 5. The tap dispenser 10 and container 20 can rest within a pedestal 370, as shown in FIG. 6. The pedestal 370 can be provided with an opening or slot 380. The liquid flow pathway 50 can extend through the opening or slot 380. The pedestal 370 can support the one or both of the tap dispenser 10 and container 20. The pedestal 370 can provide elevation to the system of the tap dispenser 10 and container 20 such that the user can fit a collector 390 beneath the liquid flow outlet 30 to collect liquid dispensed from the container 20. The system of the tap dispenser 10 and container 20 can be employed for dispensing liquid by arranging the two such that the liquid flow pathway 50 overhangs the edge of a resting surface such as a counter, table, washing machine or dryer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tap dispenser comprising:

a main body, said main body having a main body interior portion and an opposing main body exterior portion;

a liquid flow pathway passing through said main body;

a vent pathway passing through said main body, wherein air transport through said vent pathway is separated from liquid transport through said liquid flow pathway and wherein said vent pathway has a vent pathway inlet and an opposing vent pathway outlet;

a vent valve operably engaged with said vent pathway outlet, wherein said vent valve is a duck bill valve;

a valve cover extending from said vent pathway, wherein said valve cover at least partially encloses said vent valve, wherein said valve cover has a valve cover opening, wherein said valve cover comprises a terminal cover having a terminal cover periphery and a peripheral wall extending from said terminal cover periphery to said vent pathway outlet, wherein said terminal cover is above said vent valve, and wherein said valve cover has a valve cover drain wherein said valve cover drain has a valve cover drain invert elevation, and wherein said valve cover opening and said valve cover drain are substantially parallel;

wherein said vent valve has an invert elevation and said valve cover opening has a valve cover opening invert elevation; and a liquid flow valve operably engaged with said liquid flow pathway;

whereby air transport vented through said vent valve is retainable within said terminal cover thereby keeping a portion of said vent valve free of liquid.

2. A tap dispenser according to claim 1, wherein a portion of said liquid flow pathway and a portion of said vent pathway are in an annular relationship with one another.

3. A tap dispenser according to claim 1, wherein said liquid flow pathway has a liquid flow inlet proximal said main body and a liquid flow outlet distal to said main body wherein said liquid flow inlet is higher than said liquid flow outlet when said tap dispenser is in operable position.

4. A tap dispenser according to claim 1, wherein said vent pathway outlet is higher than said vent pathway inlet when said tap dispenser is in operable position.

5. A tap dispenser according to claim 1, wherein when said tap dispenser is in operable position said terminal cover is at an incline relative to a datum orthogonal to a gravitational liquid driving force.

6. A tap dispenser according to claim 1, wherein said valve has a valve opening at a valve opening invert elevation, wherein said valve opening invert elevation is higher than said valve cover drain invert elevation when said tap dispenser is in operable position.

7. A tap dispenser according to claim 1, wherein said vent pathway is substantially straight.

8. A tap dispenser according to claim 7, wherein said vent pathway has an open cross sectional area greater than about 6 $mm^2$.

9. A tap dispenser according to claim 8, wherein said vent pathway inlet has a fluid pervious cover.

10. A tap dispenser according to claim 1, wherein when said vent valve has a valve opening at a valve opening invert elevation and wherein said valve cover opening has a valve cover opening invert elevation, wherein when said tap dispenser is in operable position said valve cover opening invert elevation is below said valve opening invert elevation and said valve cover opening extends above said valve opening invert elevation.

11. A tap dispenser according to claim 1, wherein said valve has a valve opening at a valve opening invert elevation, wherein said valve opening invert elevation is above said valve cover drain invert elevation when said tap dispenser is in operable position.

12. A tap dispenser according to claim 1, wherein said valve cover opening is substantially perpendicular to said vent pathway inlet.

13. A tap dispenser comprising:

a main body, said main body having a main body interior portion and an opposing main body exterior portion;

a liquid flow pathway passing through said main body;

a vent pathway passing through said main body, wherein air transport through said vent pathway is separated from liquid transport through said liquid flow pathway, wherein said vent pathway has a vent pathway inlet and an opposing vent pathway outlet;

a vent valve operably engaged with said vent pathway outlet, wherein said vent valve has a valve opening at a valve opening invert elevation, and wherein said vent pathway outlet has a valve cover extending from and at least partially enclosing said vent valve, wherein said valve cover has a valve cover opening and said valve cover has a valve cover drain wherein said valve cover drain has a valve cover drain invert elevation, and wherein said valve cover opening and said valve cover drain are substantially parallel, wherein said valve cover comprises a terminal cover having a terminal cover periphery and a peripheral wall extending from said terminal cover periphery to said vent pathway outlet, wherein when said tap dispenser is in operable position said terminal cover is at an incline relative to a datum orthogonal to a gravitational liquid driving force, and wherein a portion of said terminal cover is above said valve opening and is not in direct contact with said vent pathway outlet; and a liquid flow valve operably engaged with said liquid flow pathway.

14. A tap dispenser according to claim 13, wherein said vent valve is a duck bill valve.

15. A tap dispenser according to claim 13, wherein said liquid flow pathway has a liquid flow inlet proximal said main body and a liquid flow outlet distal to said main body wherein said liquid flow inlet is higher than said liquid flow outlet when said tap dispenser is in operable position.

16. A tap dispenser according to claim 13, wherein said vent pathway inlet has a fluid pervious cover.

17. A tap dispenser according to claim 13, wherein said valve cover opening has a valve cover opening invert elevation, wherein when said tap dispenser is in operable position said valve cover opening invert elevation is below said valve opening invert elevation and said valve cover opening extends above said valve opening invert elevation.

* * * * *